US009156611B1

(12) United States Patent
Campbell et al.

(10) Patent No.: US 9,156,611 B1
(45) Date of Patent: Oct. 13, 2015

(54) FRONT LOADING GARBAGE TRUCK

(76) Inventors: Paul Campbell, Chandler, AZ (US); Wendell Perkins, Tempe, AZ (US); Ron Alderfer, Phoenix, AZ (US)

( * ) Notice: Subject to any disclaimer, the term of this patent is extended or adjusted under 35 U.S.C. 154(b) by 484 days.

(21) Appl. No.: 13/595,036

(22) Filed: Aug. 27, 2012

Related U.S. Application Data

(60) Provisional application No. 61/573,259, filed on Aug. 31, 2011.

(51) Int. Cl.
*B65F 3/04* (2006.01)
*B65F 3/20* (2006.01)

(52) U.S. Cl.
CPC ..... *B65F 3/041* (2013.01); *B65F 3/207* (2013.01)

(58) Field of Classification Search
CPC ..... B65F 3/041; B65F 3/201; B65F 3/207
USPC ..... 414/408, 551, 553, 511, 517; 296/190.03
See application file for complete search history.

(56) References Cited

U.S. PATENT DOCUMENTS

| | | | | | |
|---|---|---|---|---|---|
| 2,865,286 | A * | 12/1958 | Newell | 100/295 |
| 4,055,262 | A * | 10/1977 | Bauer et al. | 414/697 |
| 4,221,527 | A * | 9/1980 | Morrison | 414/517 |
| 4,576,540 | A * | 3/1986 | Derain et al. | 414/511 |
| 4,892,454 | A * | 1/1990 | Behling et al. | 414/406 |
| 4,940,280 | A * | 7/1990 | Templeton | 296/190.03 |
| 5,474,352 | A * | 12/1995 | Davies | 296/24.3 |
| 6,007,291 | A * | 12/1999 | Ghibaudo | 414/512 |
| 6,059,511 | A * | 5/2000 | Anderson et al. | 414/408 |
| 7,063,495 | B1 * | 6/2006 | Johnson | 414/511 |
| 7,419,348 | B2 * | 9/2008 | Byrne | 414/525.2 |
| 7,896,605 | B2 * | 3/2011 | Davis | 414/516 |
| 7,980,805 | B1 * | 7/2011 | Holmes et al. | 414/517 |

* cited by examiner

*Primary Examiner* — Jonathan Snelting
(74) *Attorney, Agent, or Firm* — Sandy Lipkin

(57) ABSTRACT

A front loading garbage truck with a unique packing blade that creates a self-cleaning garbage truck without the need for manual clean outs and construction for the accomplishment of same. The packing blade includes a top vertical portion that is in a fixed position and a second bottom vertical portion that is retractable into a horizontal position to allow for repeated pass-throughs to collect all debris prior to emptying the garbage from the truck. Additionally, a unique cab shield sits atop the cab portion that contains a plurality of holes on the sides and along the top sloping face to allow ventilation therethrough and prevent damage to the engine caused by excessive heat.

2 Claims, 7 Drawing Sheets

FRONT LOADING GARBAGE TRUCK

REFERENCE TO PRIOR APPLICATION

This application claims the priority of provisional application 61/573,259, filed Aug. 31, 2011 entitled FRONT LOADING GARBAGE TRUCK by Paul Campbell, Wendell Perkins and Ron Alderfer.

BACKGROUND OF THE INVENTION

Front loading garbage collection trucks are common in the field of trash, garbage, refuse and/or recyclable materials removal. Typically, the truck includes an arm at the front of the truck that grabs with forks or other grabbing mechanism a trash can or other receptacle containing trash, garbage, refuse and/or recyclable materials. The grabbing mechanism is attached to an arm that travels over the top of the cab of the truck and behind the cab to an opening called a hopper and dumps the trash, garbage, refuse and/or recyclable materials can therein. Once the garbage is inside the body of the trash truck, a packing blade pushes the garbage to the rear end of the truck to make room for more trash, garbage, refuse and/or recyclable materials and to optionally allow for expulsion through the rear of the trash truck once full.

One problem that often occurs is that some of the garbage is not grabbed by the packing blade on the push through. When garbage is left behind like this, the missed garbage needs to be manually removed by the operator. To accomplish this, the driver must climb inside the body of the trash truck. Additionally, a side door is required for access as is a floor clean-out trough to remove the missed garbage.

Also with front loading garbage trucks, there is often some sort of shield over the cab of the chassis to prevent debris that may fall out of the container being dumped from falling onto the cab of the truck. These shields are solid construction, but have been known to include a single hole in the top for the chassis engine exhaust pipe. This system has problems, however, in that the action of moving over the engine and the exhaust creates heat over the cab. Engine heat trapped under this cab shield design can then enter back into the engine air intake system thereby causing engine problems.

There is a need for a front loading trash truck engine design that overcomes the aforementioned shortcomings in the prior art.

SUMMARY OF THE INVENTION

The preferred embodiment of the instant inventions teaches a front loading garbage truck comprising: a chassis; a cab attached to said chassis; four or more wheels attached to said chassis; a movable arm attached to said chassis rests in the front of said cab and that can be moved to reach over said cab and terminates in a gripping means, such as forks to grip a garbage receptacle; a large hollow body attached to said chassis and behind said cab for the placement therein of garbage through the movement of said arm; a horizontal channel on both sides of said hollow body; a horizontal member that fits inside of said horizontal channel that is movable along said horizontal channel along the length of said hollow body; a top blade that is attached to said horizontal member that is in a fixed vertical position; and a bottom blade that is attached to said horizontal member that is movable between a first vertical position and a second horizontal position.

The above embodiment can be further modified by defining that the hollow body terminates in a movable tail gate.

The above embodiment can be further modified by defining that the horizontal member ejects collected garbage through said tailgate.

The above embodiment can be further modified by defining that a cab shield rests above said cab, said cab shield having a wedge shape with a bottom portion, a first triangular shaped side portion, a second triangular shaped side portion, a back portion and a sloping top face portion extending from the top of said back portion along the angle of said first and second triangular shaped portions to said bottom portion and wherein said first and second triangular shaped portions contain a plurality of apertures for ventilation and wherein said sloping top face portion includes one or more rows containing a plurality of apertures for further ventilation.

BRIEF DESCRIPTION OF THE DRAWINGS

FIG. 3 is a side view of the trash truck of the instant invention with the packing blade moving back to the hopper section of the body of the truck with the bottom portion of the blade in the retracted position so as to pass over any missed garbage from the initial pass through.

FIG. 5 is a side view of the trash truck of the instant invention with the packing blade making a second pass through to push any garbage missed in the initial pass through.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The most basic embodiment of the instant invention is a front loading trash truck that has a two-piece, self-cleaning packer blade design that allows for the lower part of the blade to operate initially as a standard packing blade in that it pushes and packs material into the receiving body as prior art packing blades design would. Additionally, it can also push material out of the body on full eject models as with prior art designs. What is unique about the design of the instant invention is that the packing blade has two parts: a top portion that remains vertical and a bottom portion that is retractable along the radius of the internal surface of the hopper section of the inside of the truck.

The retracting function of the lower part of the packing blade is unique in that the lower part of the blade will sweep upward from its initial vertical position into a second horizontal position before the packing blade returns to the front end of the hopper. Once the packing blade returns to the front end of the hopper, it returns to the vertical position for a second pass through, thereby moving any refuse that may have been missed during the initial pass through. Because of this function, there is no need for a side door for the operator to enter the body and there is no floor clean-out required for refuse removal. In this sense, the retractable bottom portion of the packing blade creates a self-cleaning front loading garbage truck.

The garbage truck of the instant invention also includes a unique cab shield that is designed to let air flow through from the front of the unit as it travels down the street. It also provides for the flow of exhaust through the sides and the rear. This allows heat and exhaust from the chassis engine to escape without harming the engine air intake system during use.

Figure 1:
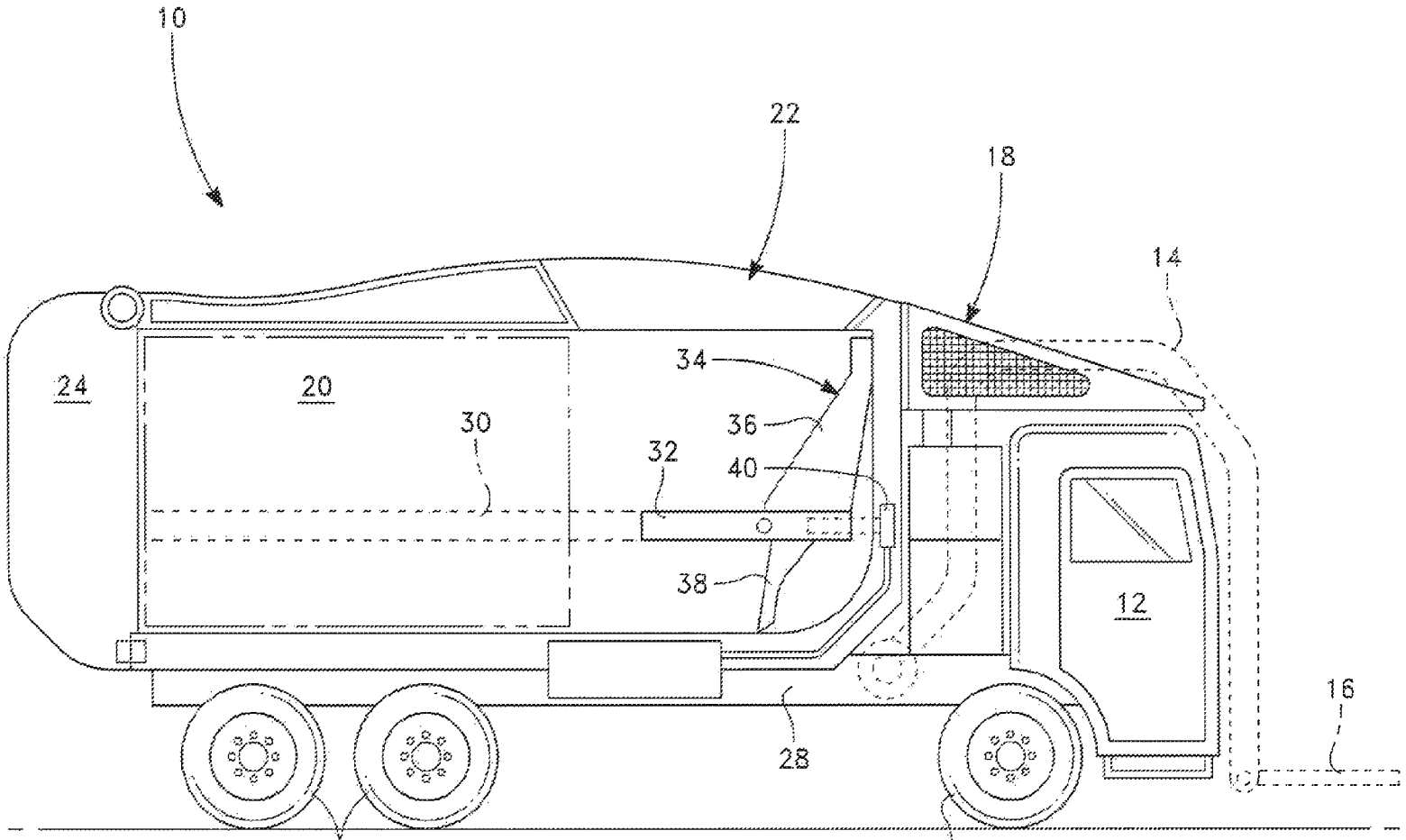
FIG. 1 is a side view of the trash truck of the instant invention without any garbage inside.

FIGS. 1-6 show a side view of the trash truck 10. In FIG. 1, the truck 10 is empty. The front components of the truck 10 include the cab 12, the movable arms 14 and the grabbing forks 16. Above the cab 12 is the unique cab shield 18 shown in detail in FIG. 7. Behind the cab 12 is the body 20 into which garbage is collected through a hopper 22. At the rear of the body 20 is a tailgate 24 that opens for the ejection of collected garbage.

Wheels 26 are attached to the chassis 28 in order for the vehicle to move. The arm 14 is also attached to the truck 10 and is movable in a direction from the front of the cab 12 up to the top of the hopper 22. The forks 16 of the arm 14 are used to pick up a garbage container (not shown) and the arm 14 travels over the cab 12 to the top of the hopper 22 where the garbage container is dumped and the garbage 42 therein transferred through the hopper 22 into the body 20 of the truck 10. The arm 12 is controlled from inside the cab 12 by the operator (not shown).

Inside the body 20 of the truck 10 is a horizontal channel 30 that acts as a guide into which a horizontal portion 32 of the packing blade 34 sits and travels. The packing blade 34 is divided into an upper portion 36, which remains vertical at all times and a lower portion 38 that is retractable between a first vertical position and a second horizontal position. A mechanical means 40 such as a hydraulic system is used to push the packing blade 34 and its horizontal portion along the horizontal channel 30 in order to move garbage 42 from the front portion of the truck 10 to the rear portion and eventually ejected out through the back when the tailgate 24 is opened.

Figure 2:
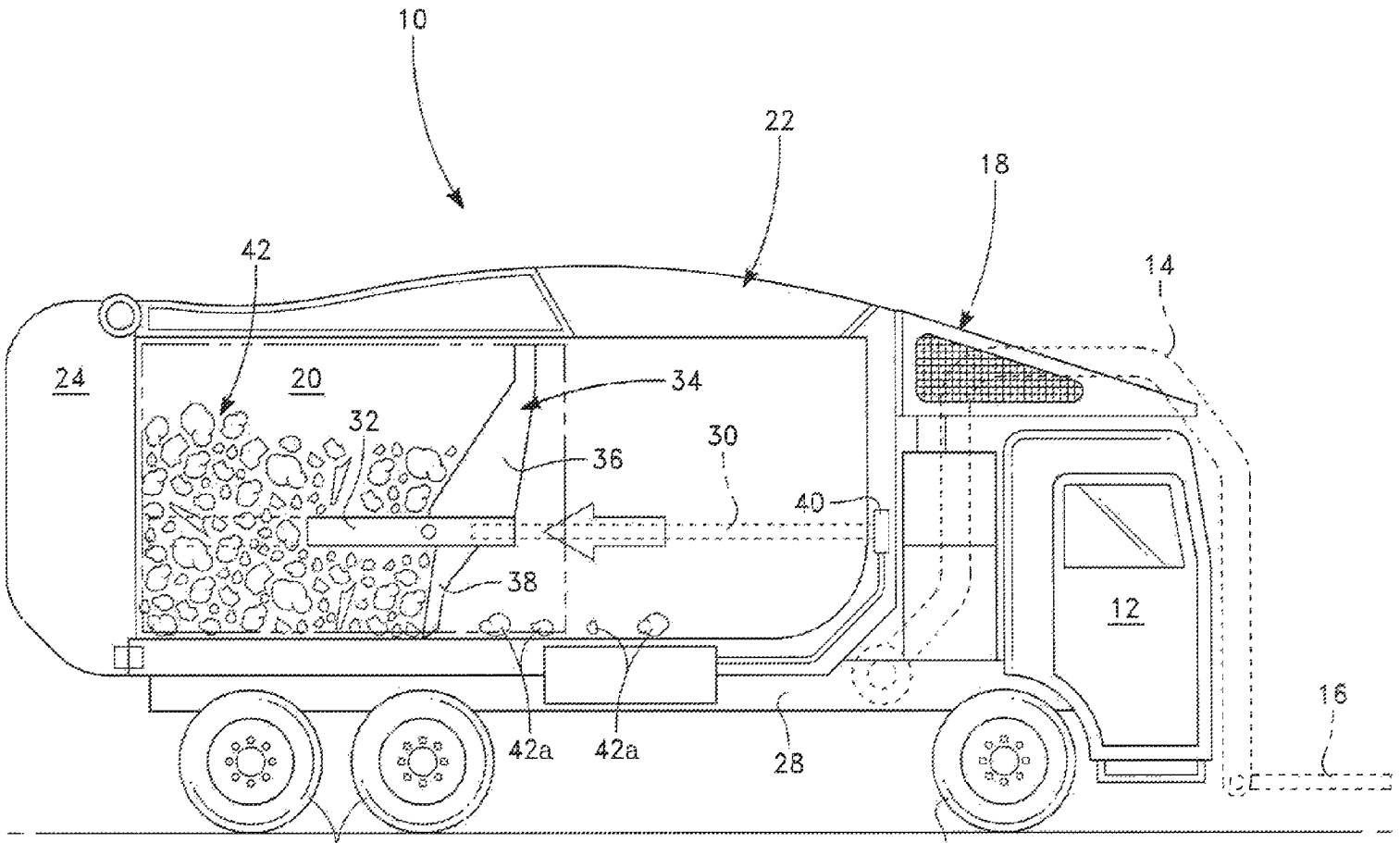
FIG. 2 is a side view of the trash truck of the instant invention with a load of garbage therein with the packing blade moving the load from the hopper portion of the body of the truck to the rear portion of the body of the truck.

As shown in FIG. 2, once the garbage 42 has been placed inside the body 20 of the truck 10, the horizontal portion 32 of the packing blade 34 is moved along the horizontal channel 30 inside of the truck 10 in a direction toward the tailgate 24 thereby moving the garbage 42 from the front of the truck 10 to the rear. As illustrated in FIG. 2, often times stray pieces of garbage 42*a* as missed by the bottom portion 38 of the packing blade 34 on the initial pass through.

Figure 3:
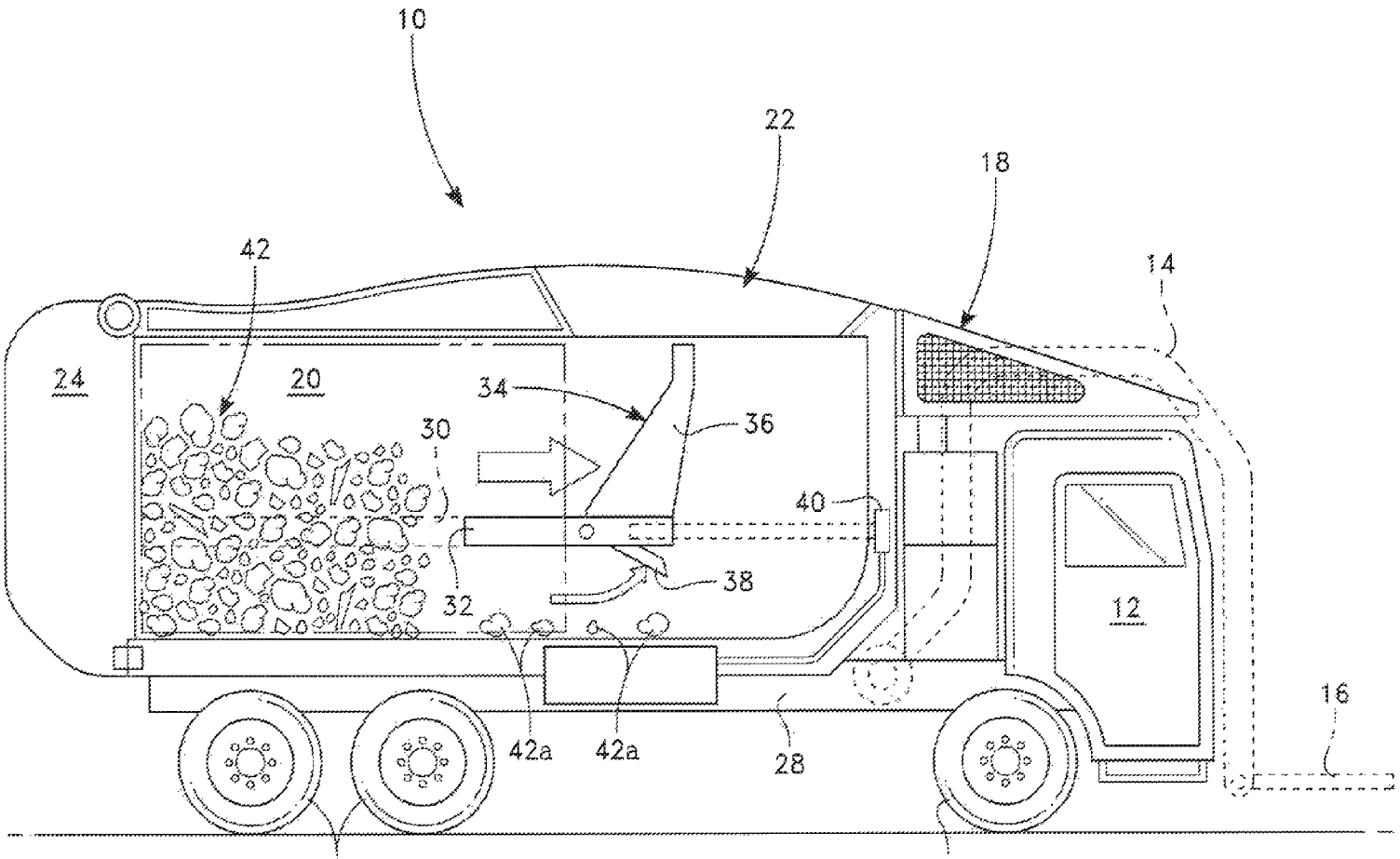
Figure 4:
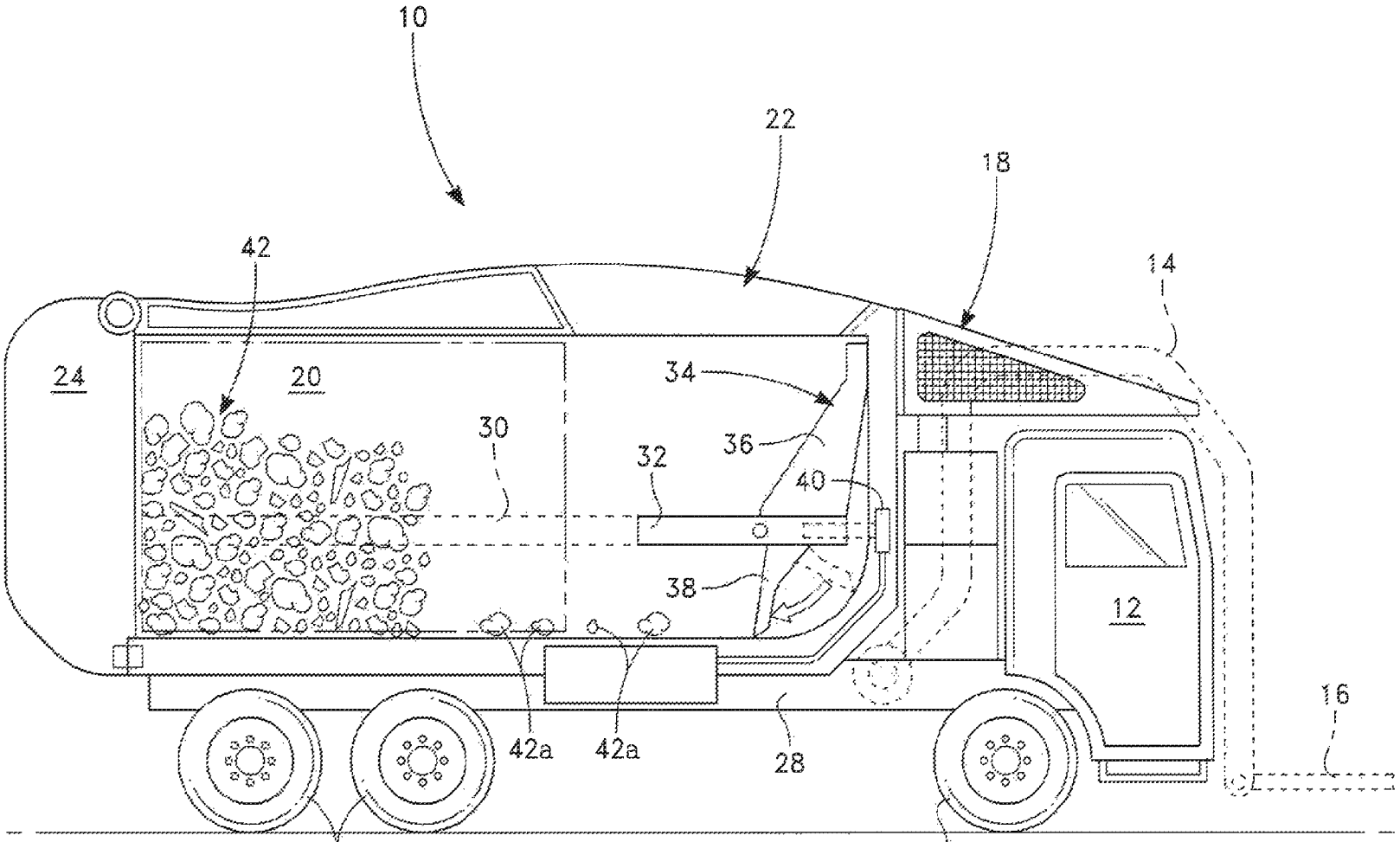
FIG. 4 is a side view of the trash truck of the instant invention with the packing blade back in the initial position and with the bottom portion of the blade returned to the vertical position having travelled along the matching radius of the bottom of the inside of the hopper section of the body of the truck.
Figure 5:
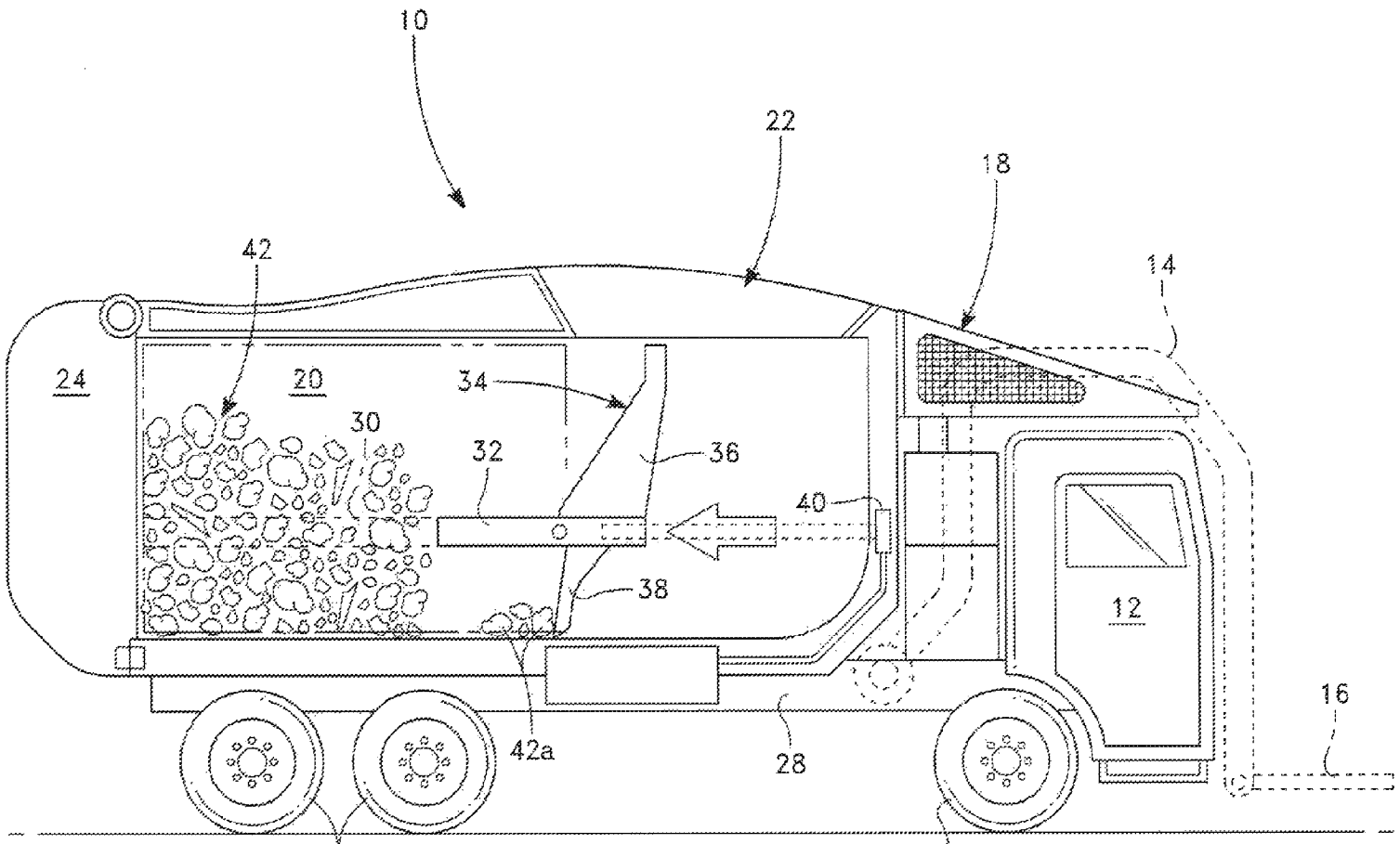

To retrieve the stray pieces of garbage 42*a*, the lower portion 38 of the packing blade retracts into a horizontal position flush with the horizontal portion 32 of the packing blade 34 as seen in FIG. 3. The horizontal portion 32 of the packing blade 34 then moves along the horizontal channel 30 in a direction back toward the front of the truck 10. Illustrated in FIG. 4, the packing blade 34 has returned to the front end of the truck 10 at which point the bottom portion 38 of the packing blade is returned to the original vertical position. FIG. 5 illustrates the second pass through wherein the stray pieces of garbage 42*a* are then moved along by the bottom portion 38 of the packing blade 34 and packed with the larger compact collection of garbage 42.

Figure 6:
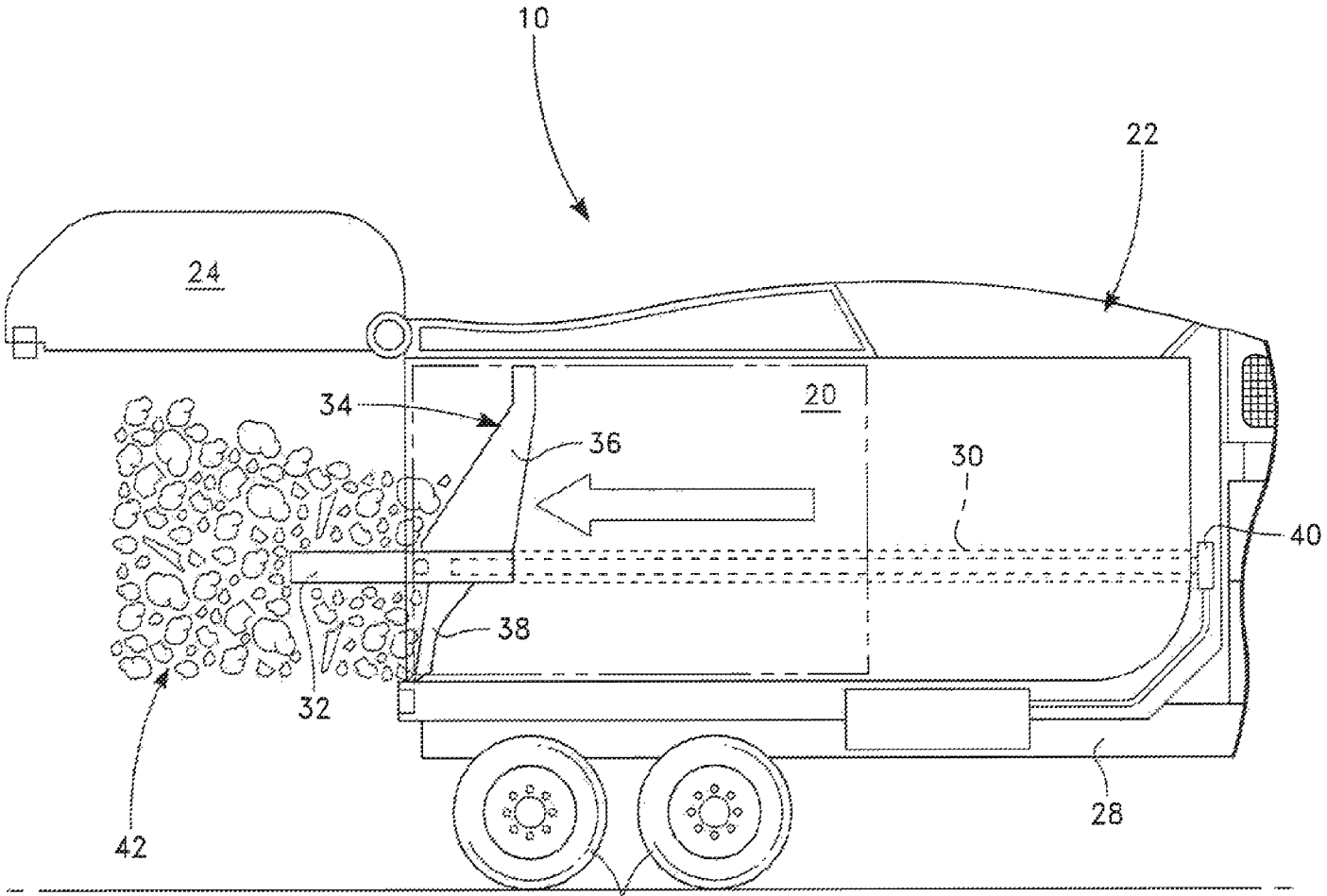
FIG. 6 is a side view of the trash truck of the instant invention with the packing blade in the ejecting position ejecting the collected garbage through the rear of the body of the truck.

For rear ejection trucks, the tail gate 24 is opened as shown in FIG. 6 and the horizontal portion 32 of the packing blade 34 extends through the rear of the truck at which point the compacted garbage 42 is released from the body 20 of the truck 10.

Figure 7:
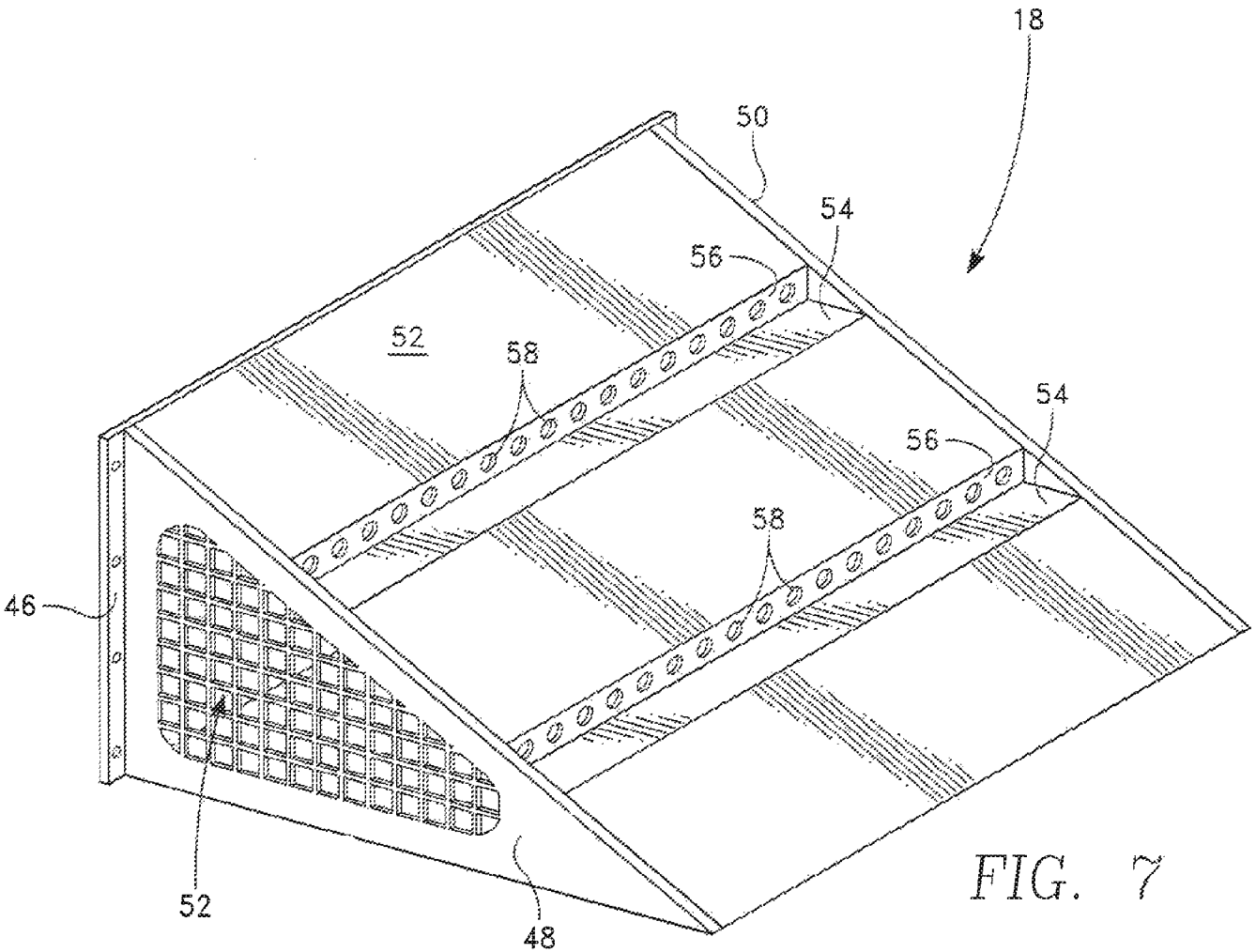
FIG. 7 is a perspective view of the cab shield that sits atop the cab chassis as seen in FIGS. 1-5.

FIG. 7 is a close up perspective view of the cab shield 18 which sits over the cab 12 of the truck 10 of the instant invention. The shield 18 is a wedge shape with a back portion 46 that attaches to the body 20 of the truck, a first side 48, a parallel second side 50 and a sloping top face 52. The back portion 46 and the first and second side portions 48, 50 contain a plurality of holes 58 that allow for the flow of air therethrough. On the sloping top face 52, there is at least one row 56 that includes a flat base with a perpendicular wall 54 extending upward therefrom. Along the perpendicular wall 54 is a plurality of apertures 58 that allow for further airflow therethrough.

The design of the cab shield 18 is created to allow air flow through from the front of the unit as it travels down the street as well as for exhaust to flow through the sides and the rear. This allows for heat and exhaust from the chassis engine to escape.

The foregoing description of the preferred embodiments of the invention has been presented for the purposes of illustration and description. It is not intended to be exhaustive or to limit the invention to the precise form disclosed. Many modifications and variations are possible in light of the above teaching, including but not limited to the mixing and matching of various elements described herein. It is intended that the scope of the invention not be limited by this detailed description, but by the claims and the equivalents to the claims appended hereto.

The discussion included in this patent is intended to serve as a basic description. The reader should be aware that the specific discussion may not explicitly describe all embodiments possible and alternatives that are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A front loading garbage truck comprising:

a chassis;

a cab attached to said chassis;

four or more wheels attached to said chassis;

a movable arm attached to said chassis rests in the front of said cab and that can be moved to reach over said cab and terminates in a gripping means to grip a garbage receptacle;

a large hollow body attached to said chassis and behind said cab for placement therein of garbage through movement of said arm;

a horizontal channel that runs along both sides of said hollow body;

a horizontal member that fits inside of said horizontal channel that is movable along said horizontal channel along said hollow body;

a top blade that is attached to said horizontal member that is in a fixed vertical position; and a bottom blade that is attached to said horizontal member that is movable between a first vertical position and a second horizontal position;

wherein a cab shield rests above said cab, said cab shield having a wedge shape with a first triangular shaped side portion, a second triangular shaped side portion wherein said first triangular portion and said second triangular portion form an angle, a back portion and a sloping top face portion extending from the top of said back portion along said angle of said first and second triangular shaped portions to said bottom portion and wherein said first and second triangular shaped portions contain a plurality of apertures for ventilation and wherein said sloping top face portion includes one or more rows containing a plurality of apertures for further ventilation.

2. The front loading garbage truck as defined in claim 1 wherein said gripping means are forks.

* * * * *